United States Patent [19]

Snell

[11] 4,032,258

[45] June 28, 1977

[54] BLADED ROTOR FOR FLUID FLOW MACHINES

[75] Inventor: Leonard Stanley Snell, Alveston, England

[73] Assignee: Rolls-Royce (1971) Limited, England

[22] Filed: June 9, 1975

[21] Appl. No.: 585,406

[30] Foreign Application Priority Data

June 26, 1974 United Kingdom ..... 28299/74

[52] U.S. Cl. ..... 416/193 A; 416/219 R; 416/222; 416/244 A

[51] Int. Cl.[2] ..... F01D 5/30

[58] Field of Search ..... 416/193 A, 193, 222, 416/219–221, 244 A

[56] References Cited

UNITED STATES PATENTS

| | | | |
|---|---|---|---|
| 905,487 | 12/1908 | Worsey | 416/220 |
| 2,888,239 | 5/1959 | Slemmons | 416/244 A |
| 2,937,806 | 5/1960 | Clarke | 416/222 X |
| 2,971,745 | 2/1961 | Warren et al. | 416/193 |
| 2,999,668 | 9/1961 | Howald et al. | 416/193 A X |
| 3,002,675 | 10/1961 | Howell et al. | 416/193 |
| 3,304,055 | 2/1967 | Britt | 416/90 |

FOREIGN PATENTS OR APPLICATIONS

| | | | |
|---|---|---|---|
| 671,512 | 12/1929 | France | 416/193 |
| 646,018 | 9/1962 | Italy | 416/193 |
| 189,131 | 3/1923 | United Kingdom | 416/196 |
| 740,757 | 11/1955 | United Kingdom | 416/219 |
| 1,212,167 | 11/1970 | United Kingdom | 416/193 |

*Primary Examiner*—Everette A. Powell, Jr.
*Attorney, Agent, or Firm*—Stevens, Davis, Miller & Mosher

[57] ABSTRACT

The disclosure of this invention pertains to a bladed rotor for gas turbine engines wherein each blade has a root portion connected to a blade support element spaced radially outwardly from the rim of a single disc and being of greater axial extent than the rim. The element is connected to the rim by a web extending in part radially outside the rim and in part at the sides of the rim.

4 Claims, 4 Drawing Figures

BLADED ROTOR FOR FLUID FLOW MACHINES

This invention relates to a bladed rotor for fluid flow machines.

It is known for such rotors to comprise a disc on which blades are supported by engagement of root portions of the blades with appropriate blade support elements on the disc, wherein the blade support elements on the disc, and wherein the blade support elements are elongate across the periphery of the disc and the disc has directly adjacent said elements a circumferentially continuous rim portion whose axial extent is equal to or even greater than the axial extent of said elements.

Said circumferentially continuous rim portion was thought, in the past, to be necessary for the strengthening and support of the blade support elements, and in cases where the elements were situated on a diameter which is high in relation to the safe hoop stress of the material from which the disc is made, said safe hoop stress was a limiting condition in cases where it was desired to increase said diameter.

It is an object of this invention to provide a rotor wherein the respective functions of blade support and hoop strength are separated so that the disc may be designed to satisfy these functions more nearly optimally.

According to this invention a bladed rotor for fluid flow machines comprises a single disc, an annular array of blade support elements situated radially outwardly and spaced from the periphery of the disc, the elements being elongate in a direction across said periphery, each element having end portions overhanging the respective sides of the disc, a web connected between said element and said disc, the web having a single portion where extending between said element and said periphery and separate portions extending at the respective sides of the disc.

The invention will now be described by way of example and with reference to the accompanying drawings wherein:

FIG. 5 is a side elevation of a gas turbine engine embodying a turbine rotor according to this invention.

FIG. 6 is an enlarged and fragmentary perspective view of the rotor shown in FIG. 5.

Figure 2:
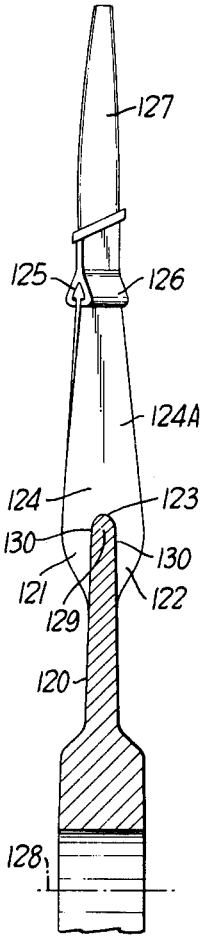
FIG. 2 is a section on the line II — II in FIG. 1.
Figure 1:
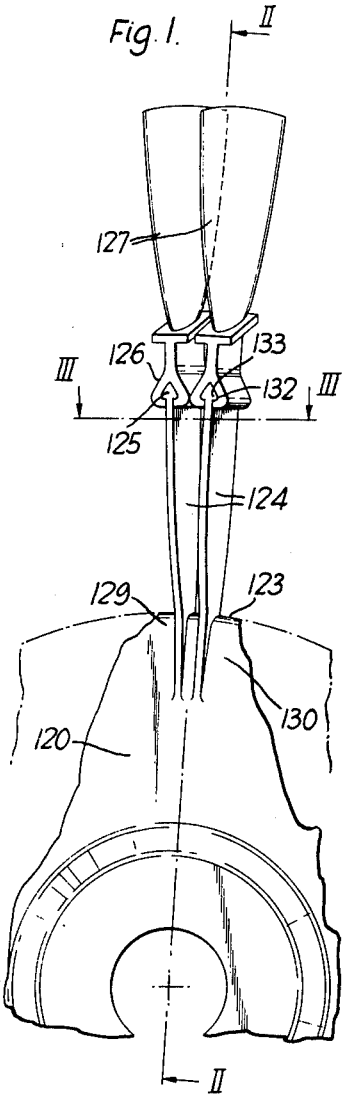
FIG. 1 is a fragmentary axial elevation of a compressor rotor according to this invention.
Figure 3:
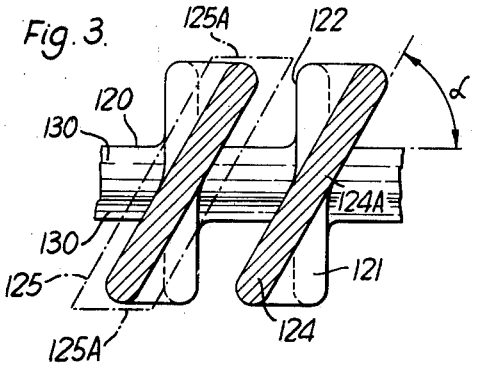
FIG. 3 is a section on the line III — III in FIG. 1.
Figure 4:
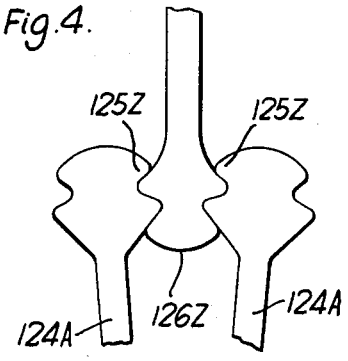
FIG. 4 is a view similar to FIG. 1 but showing modifications.

Referring to FIGS. 1 to 3 the rotor comprises a single disc 120 supporting an annular array of blade support elements 125 situated radially outwardly of, and spaced from, the disc periphery 123. The elements are elongate in a direction across the periphery 123. This direction is given by the stagger angle $\alpha$ (FIG. 3). Having regard to the axis, denoted 128, of the disc, the axial extent of the elements 125 is greater than that of the rim, denoted 129, of the disc so that each element 125 has end portions 125A extending axially beyond the sides, denoted 130, of the rim. Each element 125 is connected to the disc 120 by a radial web 124 having portions 121, 122 which extend radially inwardly of the periphery 123 and are integral with the respective sides 130 of the rim 129, and the web 124 further having a single portion 124A extending between the periphery 123 and the element 125.

The reason for the division of the web 124 into the two portions 121, 122 is that the axial extent of the web 124 as determined by that of the elements 125, and otherwise by considerations of centrifugal and bending stress, is necessarily greater than the axial extent, i.e. the thickness, of the rim 129 which is determined primarily by the hoop stress acting in the rim. The radial length of portions 121, 122 depends of course on the shear strength necessary at their junction with the rim to withstand the centrifugal force acting on the web 124.

The rotor further includes an annular array of compressor blades 127 each having a root portion 126 connected to an associated one of the blade support elements 125. The root portion 126 comprises two parallel portions 131 disposed at opposite sides of the element 125 and each having a recess 132 engaged by a projection 133 of the adjacent side of the element. The overall width of the root portion 126 is equal to or somewhat less than the pitch of the elements 125 so that adjacent portions 126 abut and support each other circumferentially in operation.

The cross-section of the web portion 124A is of course elongate in accordance with the elongate shape of the elements 125 and at the junction with the element 125 the stagger angle of the web cross-section is the same as that of the element. However, the web may have a twisted shape in the sense of the stagger angle of the web cross-section progressively increasing so that at the junction of the web and the periphery 123 the stagger angle is 90° as indicated in FIGS. 1 and 3.

The provision of the webs enables the disc to be made of desirably small diameter in relation to the diameter at which the blades have to be arranged. More specifically, the invention makes it possible for the periphery of the disc to lie within the safe hoop stress diameter for the particular material of which the disc is made and the speed and temperature at which it is required to run, while the blades may be arranged outside said safe stress diameter at a position required for high peripheral speeds. The usual bore in the center of the disc should be of minimum diameter, even zero, to make it possible to minimize the periphery of the disc.

Further, the relatively small diameter disc to some extent isolates the disc from the higher temperatures existing in operation in the region of the blades so that the extent of radial temperature gradients during warming and cooling is reduced and the stress conditions in the disc are moderated. Especially, the spaces between the web portions 124A allow for the circulation of cooling air.

I claim:

1. A bladed rotor for fluid flow machines comprising a single disc, an annular array of blade support elements situated radially outwardly and spaced from the periphery of the disc, the elements being elongate in a direction across said periphery, each element having end portions overhanging the respective sides of the disc, a web extending between each said element and the disc, each web also extending generally transversely to the plane of the disc and having near the periphery of the disc two portions extending radially along the respective sides of the disc, said webs and said portions thereof being a single integral whole with the disc, each blade having a root portion comprising two parallel portions disposed at opposite sides of the associated blade support element, the confronting surfaces of the parallel portions each have a recess, and the blade support element has lateral projections engaging the recesses to support a blade against radially outward movement.

2. A rotor according to claim 1, wherein the cross-section of the single web portion is elongate in the same direction as the blade support element at least at the junction between the element and the single web.

3. A rotor according to claim 1, wherein that cross-section of the single web portion which lies adjacent the disc periphery is elongate in a direction having a greater stagger angle to the disc axis than the cross-section of the web portion lying adjacent the blade support element.

4. A rotor according to claim 1, wherein the overall width of each said root portion is approximately equal to the pitch of the blade support elements so that adjacent root elements are capable of abutting in operation.

* * * * *